US006141521A

United States Patent [19]

Yuuki et al.

[11] Patent Number: 6,141,521

[45] Date of Patent: Oct. 31, 2000

[54] IMAGE FORMING DEVICE AND METHOD THEREFOR

[75] Inventors: Kazuhiko Yuuki, Kawasaki; Shinji Tamaki, Tokyo; Manabu Mochizuki, Yokohama; Takeshi Saitoh, Tokyo, all of Japan

[73] Assignee: Ricoh Company, Ltd., Tokyo, Japan

[21] Appl. No.: 09/107,423

[22] Filed: Jun. 30, 1998

[30] Foreign Application Priority Data

Jun. 30, 1997 [JP] Japan ..... 9-173740

[51] Int. Cl.[7] ..... G03G 15/09; G03G 9/107

[52] U.S. Cl. ..... 399/270; 430/106.1

[58] Field of Search ..... 399/267, 270; 430/31, 106.6

[56] References Cited

U.S. PATENT DOCUMENTS 4,376,813 3/1983 Yuge et al. ..... 430/100
4,821,075 4/1989 Saito et al. .
5,455,662 10/1995 Ichikawa et al. .
5,500,719 3/1996 Ichikawa et al. .
5,502,552 3/1996 Iwata et al. ..... 355/259
5,557,382 9/1996 Tatsumi et al. .
5,627,631 5/1997 Ichikawa et al. .
5,849,452 12/1998 Takenaka et al. ..... 430/122
5,853,937 12/1998 Asanae et al. ..... 430/106.6
5,858,595 1/1999 Ziolo ..... 430/106.6

*Primary Examiner*—Richard Moses
*Attorney, Agent, or Firm*—Oblon, Spivak, McClelland, Maier & Neustadt, P.C.

[57] ABSTRACT

The invention relates to an image forming device and method therefor solving the subject matter that, if the linear speed of the developing solution carrier for that of the latent image carrier is lowered in order to secure the development capacity, the line image is deteriorated and there occurs a troublesome matter such as the blanking at the halftone rear edge. Such image forming device of the present invention is provided with a two-component magnetic brush type developing apparatus in which the developing bias composed of the DC bias and the AC bias superposed thereon is applied to the developing apparatus, and the latent image formed on the latent image carrier is developed with the two-component developing solution including the magnetic toner and the magnetic carrier. In the image forming device, the magnetic substance including percentage of the magnetic toner is set to 5 wt %~35 wt %.

8 Claims, 7 Drawing Sheets

IMAGE FORMING DEVICE AND METHOD THEREFOR

BACKGROUND OF THE INVENTION

The present invention relates to an image forming device such as electrophotographic copying machine, printer, facsimile device, etc. provided with a two-component magnetic brush type developing apparatus and a method therefor.

DESCRIPTION OF THE RELATED ARTS

The image forming device such as electrophotographic copying machine, printer, facsimile device, etc. is provided with a developing apparatus for developing the latent image formed on the latent image carrier such as photosensitive body, etc. with two-component developing solution on a developing solution carrier composed of a developing sleeve, etc. As to such developing apparatus, there exists a two-component magnetic brush type developing apparatus. Generally, the two-component developing solution composed of non-magnetic toner and magnetic carrier is employed in the two-component magnetic brush type developing apparatus. A developing bias is applied to the above-mentioned developing solution carrier from a developing bias applying medium.

In such two-component magnetic brush type developing apparatus employing the two-component developing solution composed of the non-magnetic toner and the magnetic carrier, when the developing bias including only DC bias is applied to the developing solution carrier from the developing bias applying medium, the ratio (Vs/Vp) of the linear speed Vs of the developing solution carrier to the linear speed Vp of the latent image carrier is met to 2.5~3 in order to secure the development capacity.

In the two-component magnetic brush type developing apparatus, the relationship between the ratio Vs/Vp and the density ID of the image obtained by developing the latent image on the latent image carrier is the one as shown by the solid line in FIG. 2, and the relationship between the ratio Vs/Vp and the longitudinal/lateral line width ratio is shown in FIG. 3. For this reason, when the ratio Vs/Vp is within the area 2.5 through 3, the line image becomes thin in the lateral direction and the longitudinal/lateral line width ratio becomes worse. As the result, there occurs a troublesome matter such as blanking at the halftone rear end.

In order to solve such a troublesome matter, it is necessary to cause the linear speed Vs of the developing solution carrier to approximate the linear speed Vp of the latent image carrier (namely, to cause the value Vs/Vp approximate 1). However, in the case of utilizing the developing bias including only DC bias, the development capacity cannot be secured and the image becomes faint.

In the two-component magnetic brush type developing apparatus, as one of the systems for securing the development capacity by lowering the value of Vs/Vp, there exists a system in which the developing bias composed of the DC bias mixed with the AC bias superposed thereon is applied to the developing solution carrier. In this system, the relationship between the value Vs/Vp and the image density ID is the one as shown by the dotted line AC $\hat{1}$ in FIG. 2. The two-component magnetic brush type developing apparatus in which the value Vs/Vp is set to 1 through 1.5 and the developing bias composed of the DC bias mixed with the AC bias supposed thereon is applied to the developing solution carrier has been already used in the color two-component magnetic brush type developing apparatus.

Furthermore, in the small-amount developing solution type system without the toner density control which has been developed (technically researched and developed) in the recent years, for instance, which in described in the published specification of Japanese Laid-open Patent Publication No, 64-96673/1989, two-component developing solution composed of magnetic toner and magnetic carrier is employed on many occasions.

On the other hand, the published specification of Japanese Laid-open Patent Publication No. 63-225262/1988 describes that, in the two-component magnetic brush type developing apparatus applying alternate electric field between the latent image carrier and the developing solution carrier, the functional operation of the magnetic toner is stabilized by specifying the electric resistance value of the carrier and thereby the image of high reliability can be obtained.

The published specification of Japanese Laid-open Patent Publication No. 62-63970/1987 describes that, in the two-component magnetic brush type developing apparatus, the percentage of the volume occupied by the amount of the magnetic carrier in the developing solution part to the capacity (cubic volume) of the gap space between the photosensitive body and the developing roller is specified.

The published specification of Japanese Laid-open Patent Publication No. 62-75687/1987 described that, in the two-component magnetic brush type developing apparatus, the amount of pumping up the developing solution is specified.

The published specification of Japanese Laid-open Patent Publication No. 62-75686/1987 describes that, in the two component magnetic brush type developing apparatus, the particle diameter and the resistance value of the carrier are specified.

Furthermore, there has been proposed the image forming device provided with the two-component magnetic brush type developing apparatus, in which a high-voltage power source for charging, another high-voltage power source for transferring, and still another high-voltage power source for developing are unitarily combined into one aiming at the cost-down thereof, and in the two-component magnetic brush type developing apparatus, the developing operation is performed with the developing solution compose of the magnetic toner and the magnetic carrier. Consequently, since the magnetic toner is employed therein, any toner is not attached onto the surface of the photosensitive body even when the high-voltage power source is turned on, and thereby unnecessary toner consumption can be eliminated, and in addition the occurrence of the troublesome matter such as toner scattering can be prevented.

Even in the two-component magnetic brush type developing apparatus employing two-component developing solution composed of the magnetic toner and the magnetic carrier, in order to secure the development capacity with the developing bias composed of only DC bins, it is necessary to set the value of the ratio Vs/Vp to 2.5 through 3. As the result thereof, the line image becomes worse. Consequently, there occurs the troublesome matter such as the blanking at the halftone rear end.

SUMMARY OF THE INVENTION

The present invention was made in consideration of the above-mentioned problems in order to improve such various subject matters to be solved.

It is an object of the present invention to solve and improve the above-mentioned subject matters or the defects of the prior arts (or the related arts) of the invention.

It is another object of the present invention to provide an image forming device including a two-component magnetic brush type developing apparatus, employing two-component developing solution composed of the magnetic toner and the magnetic carrier capable of securing the development capacity even when the value of the ratio Vs/Vp is lowered and the developing bias composed of the DC bins and the AC bias superposed on the DC bias is applied to the two-component magnetic brush type developing apparatus.

It is still another object of the present invention to provide an image forming device including a two-component magnetic brush type developing apparatus employing two-component developing solution composed of the magnetic toner and the magnetic carrier capable of obtaining an image of preferable line image, halftone, etc., and thereby obtaining an image of high image quality, even when the value of the ratio Vs/Vp is lowered and the developing bias composed of the DC bias and the AC bias superposed on the DC bias is applied to the two-component magnetic brush type developing apparatus.

It is still another object of the present invention to provide an image forming device including a two-component magnetic brush type developing apparatus employing two-component developing solution composed of the magnetic toner and the magnetic carrier capable of obtaining an image of preferable line image, halftone, etc., and thereby obtaining an image of high image quality, and securing the development capacity, even when the value of the ratio Vs/Vp is lowered and the developing bias composed of the DC bias and the AC bias superposed on the DC bias is applied to the two-component magnetic brush type developing apparatus.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE INVENTION

In order to attain the above-mentioned objects, the present invention realizes an image forming device provided with a two-component magnetic brush type developing apparatus for developing a latent image with two-component developing solution including magnetic toner to which a development bias composed of DC bias and AC bias superposed on each other is applied, in which the value of the magnetic substance containing percentage of the magnetic toner is set to 5 wt % through 35 wt %.

Concerning the above-mentioned image forming device, in the two-component magnetic brush type developing apparatus employing the two-component developing solution composed of the magnetic toner and the magnetic carrier, even though the ratio Vs/Vp is lowered and the developing bias composed of the DC bias and the AC bias superposed thereon is applied to the developing apparatus, the development capacitance can be secured and the image of the preferable line image, halftone, etc. can be obtained. Consequently, it is possible to obtain the image of high image quality.

Embodiment

In the image forming device including two-component magnetic brush type developing apparatus employing two-component developing solution composed of the magnetic toner and the magnetic carrier, it in necessary to bring the ratio Vs/Vp infinitely close to 1 and thereby secure the development capacity in order to solve the above-mentioned troublesome matters and obtain the image of high image quality. In such manner, the improvement of the development capacity was tried by applying the developing bias composed of the DC bias and the AC bias superposed thereon to the developing apparatus.

Figure 4:
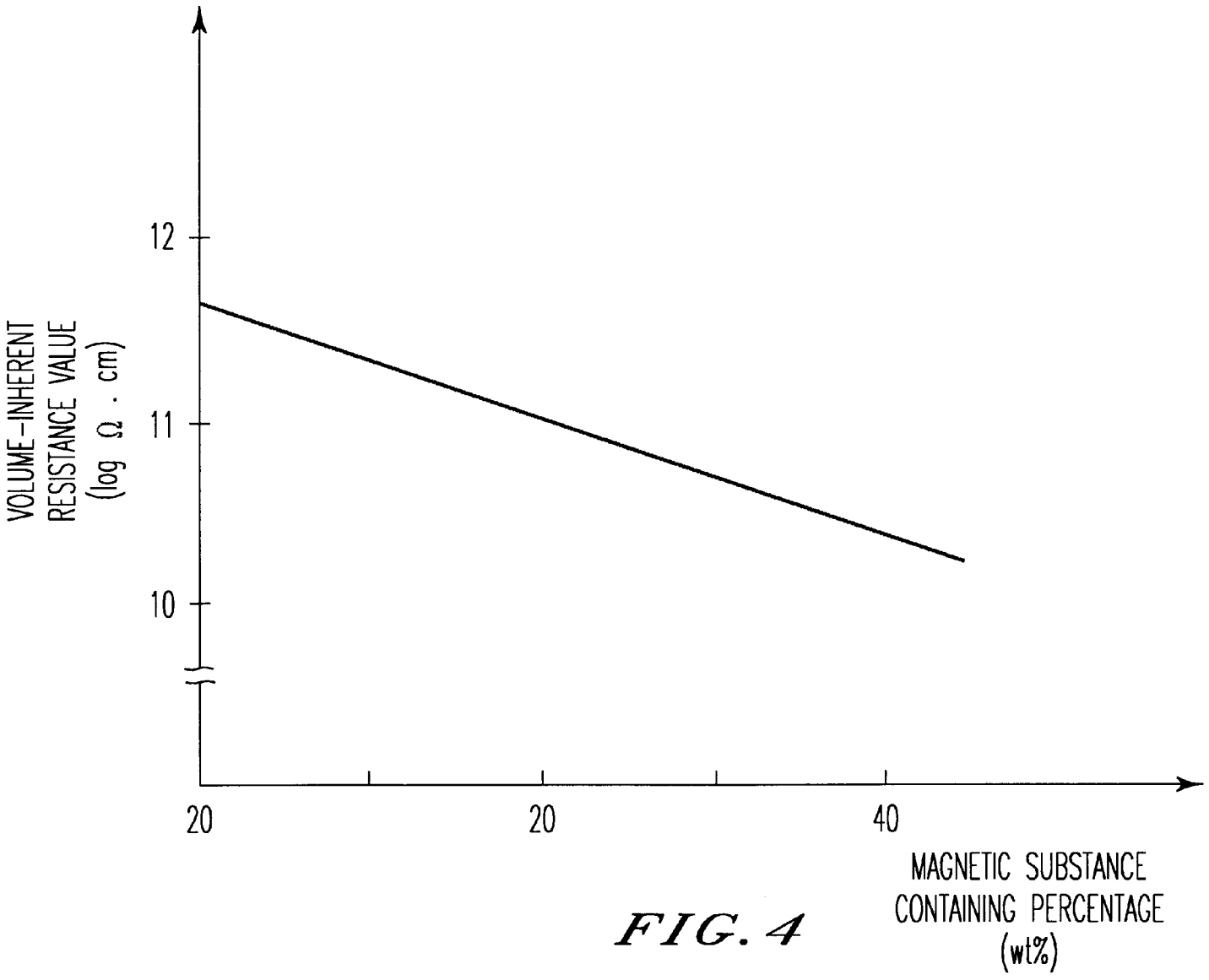
FIG. 4 is a property diagram showing the relationship between the magnetic substance containing percentage and the volume-inherent resistance value for the sole magnetic toner.

However, although the resistance value of the magnetic toner in the state of a simple body is lower than that of the non-magnetic toner as shown in FIG. 4, in case that the magnetic toner is mixed with the magnetic carrier and the mixture as the developing solution is put on the developing solution carrier composed of the developing sleeve, the resistance value of the magnetic toner becomes high as shown in FIG., 6, and thereby it is found out that the effect of superposing the AC bias onto the developing bias disappears.

Figure 2:
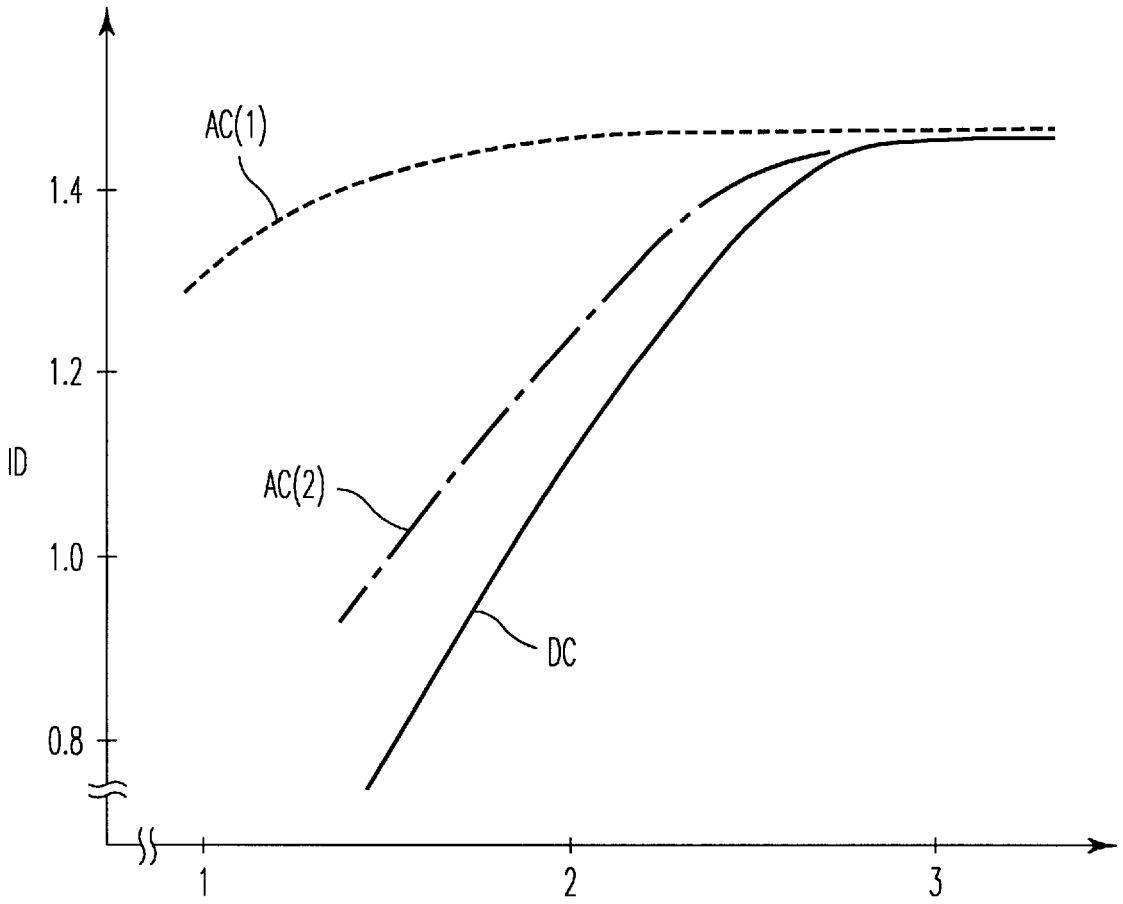
FIG. 2 PRIOR ART
FIG. 2 is a property diagram showing the relationship between the ratio Vs/Vp and the image density ID in the respective prior-art two-component magnetic brush type developing apparatuses.
Figure 3:
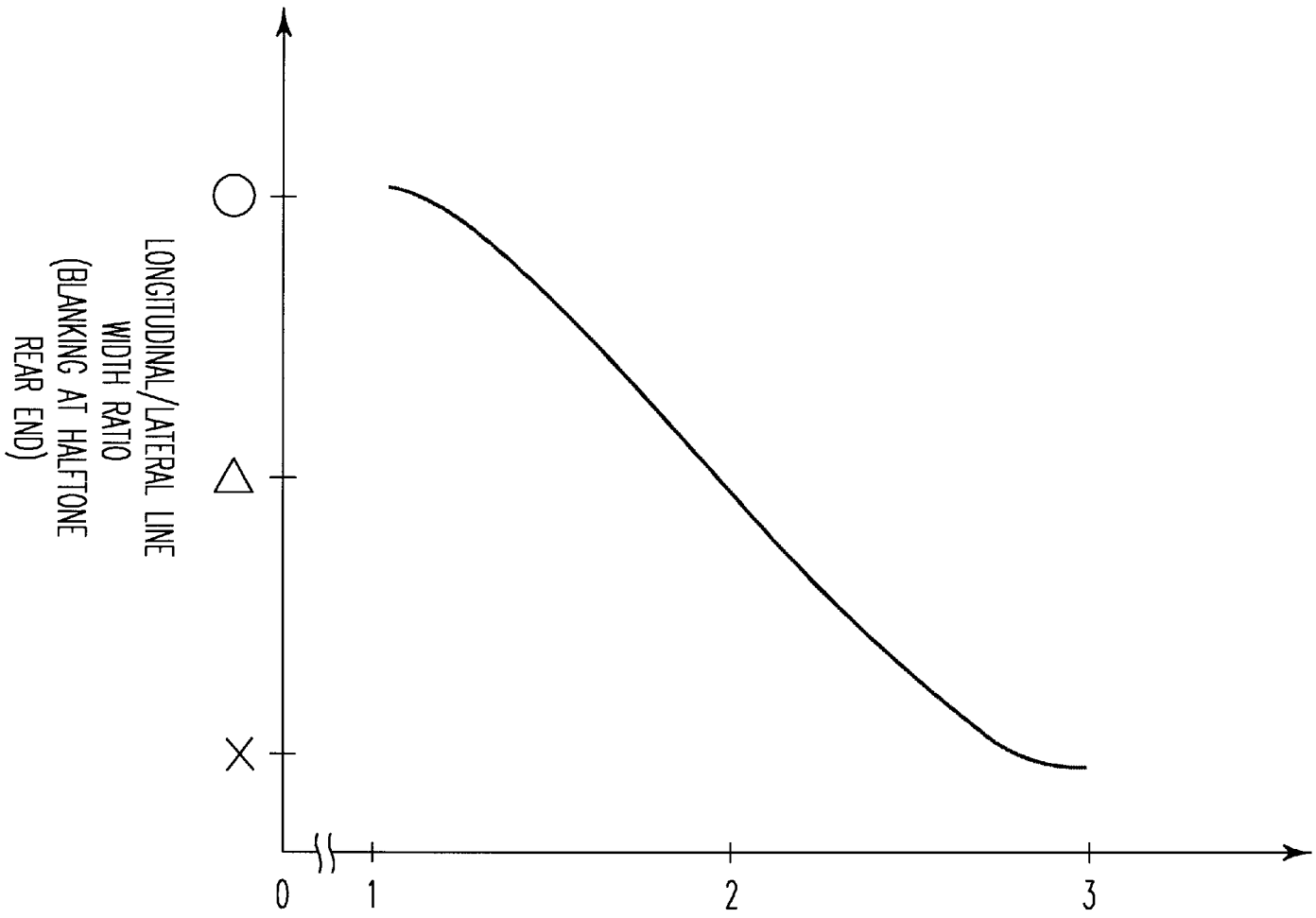
FIG. 3 PRIOR ART
FIG. 3 is a property diagram showing the relationship between the ratio Vs/Vp and the longitudinal/lateral line width ratio in the prior-art two-component magnetic brush type developing apparatus.

Namely, in the image forming device including the two-component magnetic brush type developing apparatus in which the developing bias composed of the DC bias and AC bias superposed thereon is applied to the developing sleeve, in the case of employing the two-component developing solution composed of the non-magnetic toner and the magnetic carrier, the relationship between the ratio Vs/Vp and the image density ID is the one as shown by AC 1 in FIG. 2. On the other hand, in the case of employing the two-component developing solution composed of the magnetic toner and the magnetic carrier, the relationship between the ratio Vs/Vp and the image density ID is the one as shown by AC 2 in FIG. 2.

Figure 8A:
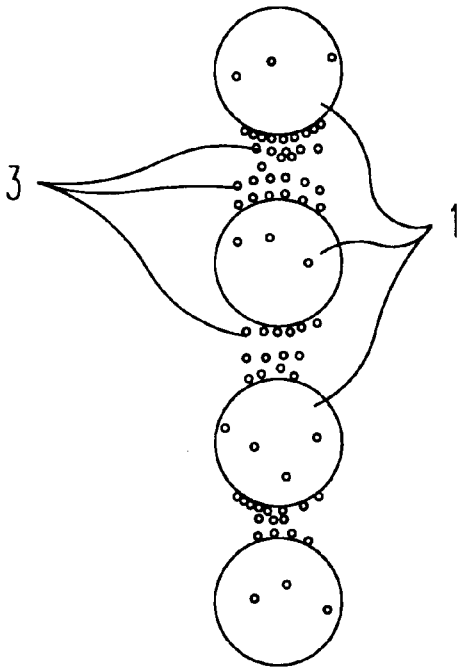
FIGS. 8A and 8B are diagrams illustrating a magnetic brush chain composed of the combination of the magnetic toner and the magnetic carrier and another magnetic brush chain composed of the combination of the non-magnetic toner and the magnetic carrier.
Figure 8B:
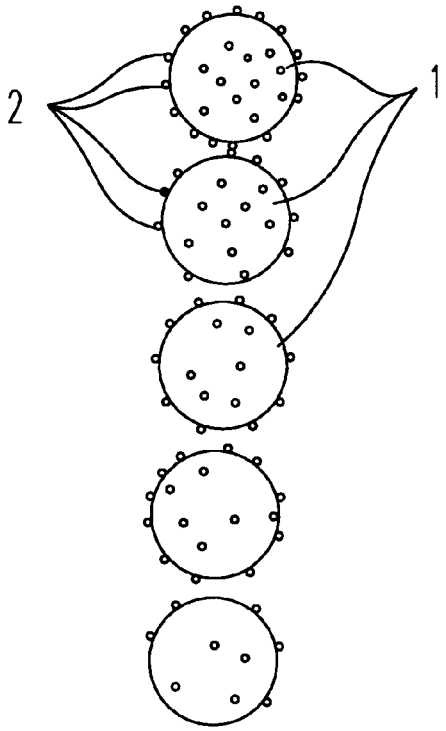

The one reason thereof is that the state of the chain of the magnetic brush is different for the developing solution composed of the combination of the magnetic toner and the magnetic carrier and for the other solution composed of the combination of the non-magnetic carrier. Observing the state of the chain of the magnetic brush, in the case of employing the developing solution composed of the combination of the non-magnetic toner and the magnetic carrier, the magnetic carrier 1 is uniformly covered with the non-magnetic toner 2 as shown in FIG. 8B, while, in the case of employing the developing solution composed of the combination of the magnetic toner and the magnetic carrier, the amount of the magnetic toner 3 for covering the magnetic carrier 1 is small as shown in FIG. 8A, and thereby a probability of sandwiching the magnetic toner 3 between the reactive magnetic carriers 1 along a line of magnetic force turns out to be raised.

Regarding the developing solution composed of the combination of the magnetic toner and the magnetic carrier, in order to lower the ratio Vs/Vp and apply the developing bias composed of the DC bias and the AC bias superposed thereon to the developing solution carrier aiming at obtaining high image quality, it is necessary to control the amount of the magnetic substance in the toner.

In such situation, according to the embodiment of the present invention, in the image forming device provided with the two-component magnetic brush type development apparatus in which the developing bias composed of the DC bias and the AC bias superposed thereon is applied to the developing solution carrier from the developing bias applying medium and the latent image formed on the latent image carrier is developed with the two-component developing solution composed of the magnetic toner and the magnetic carrier, the percentage of containing the magnetic substance of the above-mentioned magnetic toner is set to 5 wt % through 35 wt %. In such structure as mentioned above, even though the ratio Vs/Vp is lowered the developing bias composed of the DC bias and the AC bias superposed thereon is applied to the developing solution carrier, the development capacity can be secured, and in addition, the image of preferable line image and halftone can be obtained and thereby the image of high image quality can be obtained.

Figure 5:
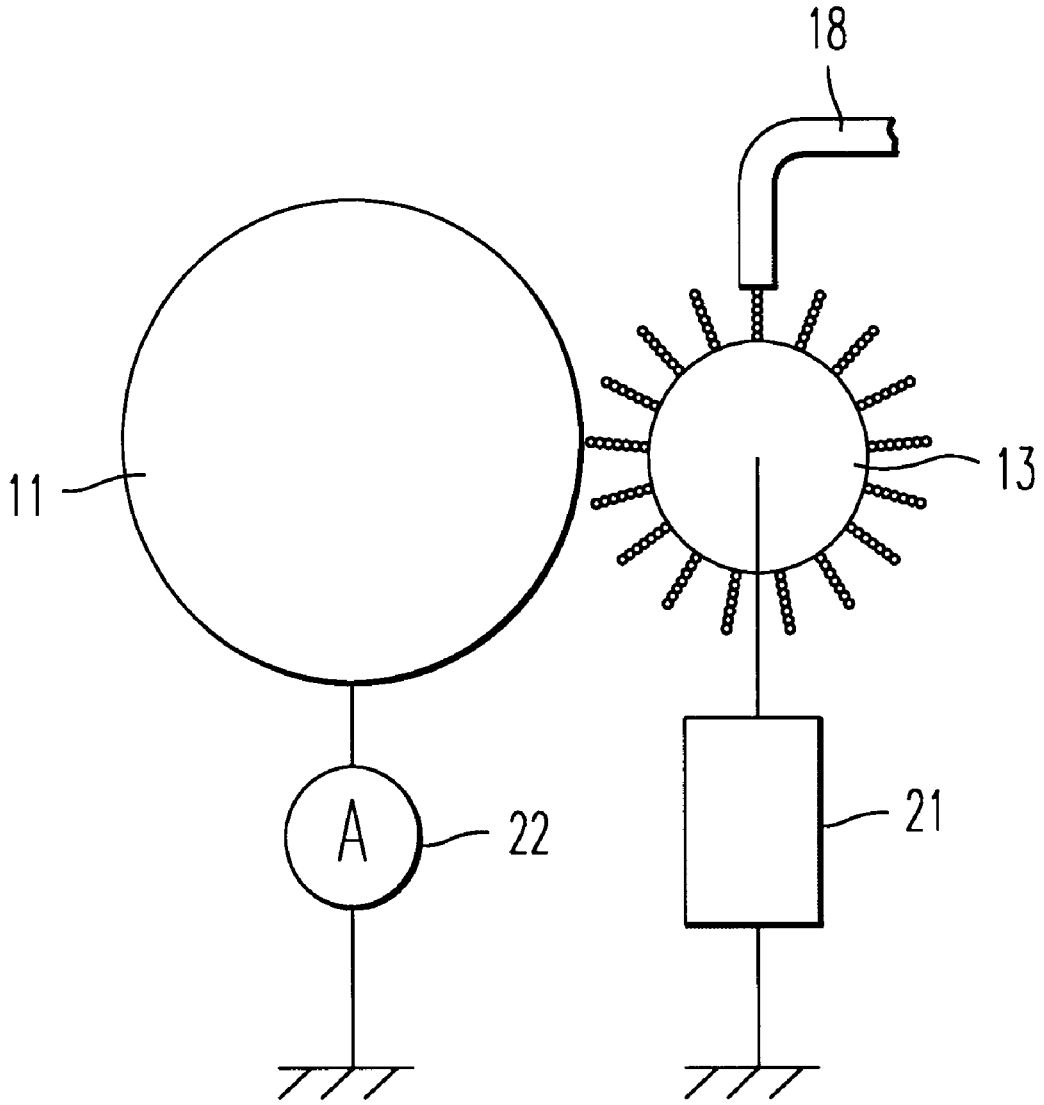
FIG. 5 is an explanatory diagram explaining the system for measuring the resistance value of the developing solution layer on the developing sleeve.
Figure 6:
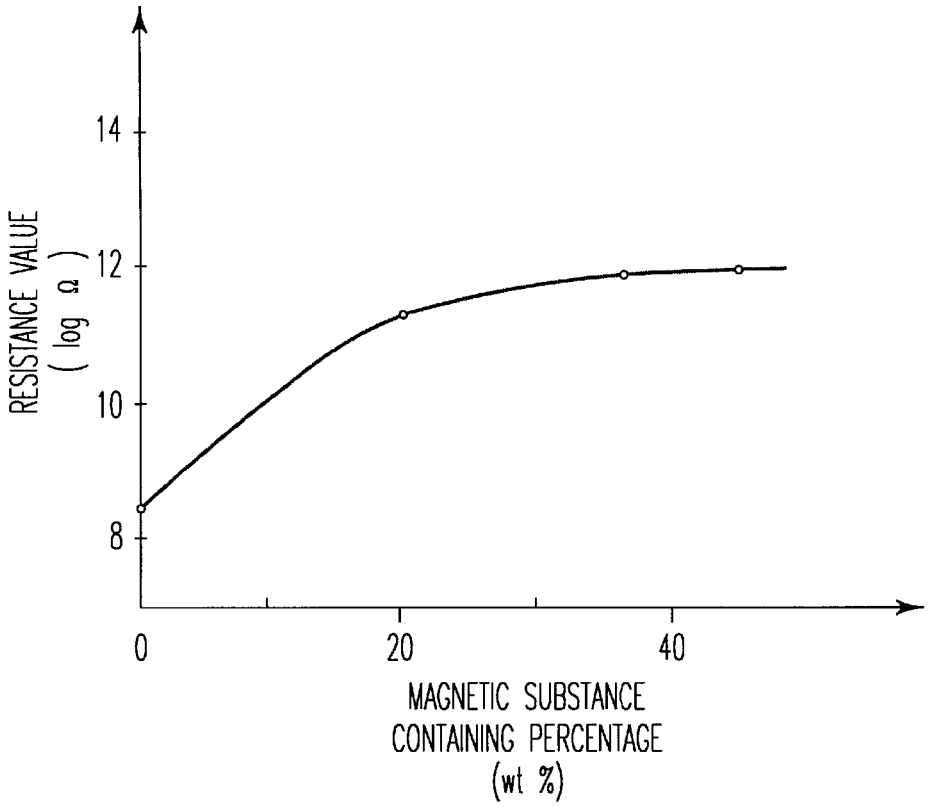
FIG. 6 is a property diagram showing the relationship between the magnetic substance containing percentage and the volume-inherent resistance value of the magnetic toner in the case of putting the mixture of the magnetic toner and the magnetic carrier as the developing solution on the developing sleeve.

Moreover, regarding the measurement of the resistance value of the above-mentioned magnetic toner, in the image forming device including the two-component magnetic brush type developing apparatus employing the two-component developing solution as shown in FIG. 5, a predetermined voltage is applied to the developing solution carrier 13 composed of the magnetic sleeve from the developing bias applying medium 21 composed of the high-voltage power source, and the electric current flowing to the ground GND (earth) from the latent image carrier 11 composed of the drum-shaped photosensitive body is measured by the electric current meter 22. The resistance value of the developing solution layer on the magnetic sleeve 13 is calculated in accordance with the measured current. In such manner, the resistance value of the magnetic toner can be obtained.

Figure 1:
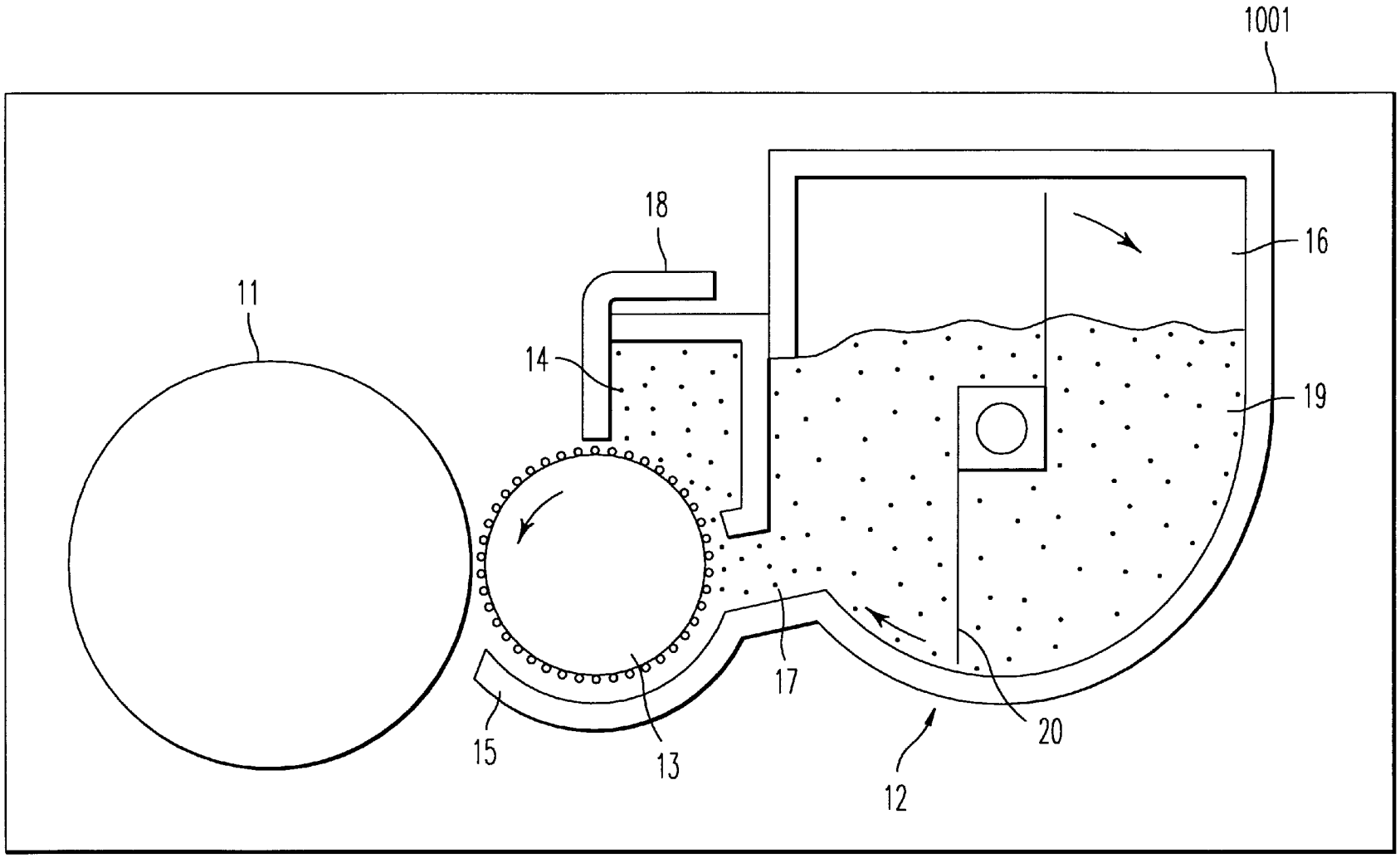
FIG. 1 is a cross-sectional view illustrating the outline of an embodiment of the present invention.

FIG. 1 shows the outline of an embodiment of a latent image informing apparatus 1001 according to the present invention. A latent image carrier 11 is rotatively driven by a relatively driving section and the latent image is formed by a latent image forming medium. For instance, a drum-shaped photosensitive body is employed as the latent image carrier 11. After the surface of the photosensitive body 11 is uniformly charged by a charging medium, the surface thereof is light-exposed by use of the light-exposing medium of the light writing-in apparatus, etc., and thereby the image is written in on the photosensitive body. In such manner, an electrostatic latent image is formed thereon.

The electrostatic latent image formed on the surface of the latent image carrier 11 is developed by the two-component magnetic brush type developing apparatus 12 employing the two-component developing solution composed of the magnetic toner and the magnetic carrier, and thereby the latent image is converted to visible image (toner image). The toner image is transferred onto the transfer material such is transfer paper, OHP sheet, etc. by use of a transferring apparatus.

The two-component magnetic brush type developing apparatus 12 is a small amount developing solution system without the function of the toner density control which employs the two-component developing solution composed of the magnetic toner and the magnetic carrier (refer to the published specification of Japanese Laid-open Patent Publication No. 64-96673/1989).

The developing apparatus 12 is constructed such that the developing solution accommodating case 15 in which the two-component developing solution 14 composed of the magnetic toner and the magnetic carrier romaine (stays) around the developing solution carrier 13 composed of the developing sleeve is connected to the toner replenishing section 16 composed of a toner hopper for accommodating the toner by the intermediation of the toner replenishing path 17, and the toner is replenished from the toner hopper 16 to the developing solution accommodating case 15. The developing bias composed of the DC bias and the AC bias supposed thereon is applied to the developing sleeve 13 from the developing bias applying medium composed of a high-voltage power source.

Being rotatively driven by the rotative drive section, the developing sleeve 13 magnetically attracts the developing solution 14 in the developing solution accommodating case 15 by the action of the magnet contained therein and carries the developing solution therein. The developing sleeve 13 conveys the carried developing solution being accompanied with the rotation therewith, end the height (amount) of the developing solution is controlled (restricted) to a constant value by the action of the doctor blade 18. The electrostatic latent image on the latent image carrier 11 is developed by the developing solution on the developing sleeve 13 in the developing area between the latent image carrier 11 and the developing sleeve 13. The toner 19 in the toner hopper 16 is agitated by the replenishing/agitating member 20 and replenished to the developing solution 14 in the developing solution accommodating case 15 through the toner replenishing path 17.

When the toner density of the developing solution is within the suitable range, the opening part for the toner replenishment for the developing solution remaining part in the developing solution accommodating case 15 (the part for replenishing the toner from the toner replenishing path 17) is closed with the remaining (staying) developing solution, and thereby the toner cannot be replenished to the developing solution in the developing solution accommodating case 15.

On the other hand, when the toner is consumed by the action of development, the toner density in the developing solution is lowered and thereby the amount of the developing solution is decreased. Consequently, the developing solution remaining at the opening part for replenishing the toner to the developing solution recalling part in the developing solution accommodating cane 15 disappears, and thereby the toner flaws into the developing solution accommodating case 15 from the toner hopper 16 through the toner replenishing path 17. In such way, the toner replenishment is performed and the toner density of the developing solution in the developing solution accommodating cane 15 is restored to the predetermined toner density.

The development condition of the two-component magnetic brush type developing apparatus 12 is shown as follows:

(1) Gap between the Latent Image Carrier 11 and the Developing Sleeve 13—0.4/0.05 mm (2) Gap between the Developing Sleeve 13—0.4±0.05 mm and the Doctor Blade 18—0.3±0.05 mm (3) Magnetic Force of the Main Pole of the Magnet in the Developing Sleeve 13—85±10 mm (4) Resistance Value of the Magnetic Carrier—Volume-Inherent Resistance Value; Approx. 9 through 11 LogΩ/cm As the magnetic toner employed in the above-mentioned embodiment according to the present invention, it is possible to use the one manufactured by the method well known in the conventional method of the prior art. To state more concretely, the magnetic toner can be obtained in such a manner as that, after melting and mixedly kneading the mixture composed of firmly-binding resin, magnetic substance, and magnetic polarity controlling agent, and further optional annexing agent (addition) as occasion demands by use of the thermal rolling mill, the magnetic toner is cooled and solidified, and crushed into pieces and further mixed with externally applied annexing agent.

As the aforementioned firmly-finding resin, it is possible to use all of the well-known resins. For instance, it is possible to use single substance or mixture of the materials, for instance, represented by homopolymer of styrene and its substitution product (compound) such as polystyrene, poly-p-chlorostyrene, and polyvinyl toluene, styrene copolymers such as styrene-p-chlorostyrene copolymers, styrene-propylene copolymers, styrene-vinyl toluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-maleic acid copolymers, and styrene-maleic acid ester copolymers, polymethyl methacrylate, polybutyl methacrylate, polyvinyl chloride, polyvinyl acetate, polyethylene, polypropylene, polyester, polyurethane, polyamide, epoxy resins, polyvinyl butyral, acrylic resins, rosin, modified rosin, terpene resins, phenolic resins, aromatic or aliphatic hydrocarbon resins, aromatic petroleum resins, chlorinated paraffin, and paraffin wax(es).

In particular, polyester resins is employed as the above-mentioned firmly-binding resin, and thereby it is possible to obtain the toner which is superior in the resistance to adhesion to polyvinyl chloride mats and further superior in the offsetproof property for thermal roller of the fixing apparatus.

Furthermore, it may be allowable to use the substances which are well known hitherto as the polarity control agent usable for the magnetic toner. For instance, for the purpose of obtaining such polarity control agent, there exist the substances such as monoazo dyes of metal complexes, nitrohumic acid and salts thereof, salicylic acid, naphthoic acid, and dicarboxylic acid, all of metal complex of Co, Cr, and Fe, etc., amino compounds, treated (processed) with quaternary ammonium compounds, and organic dyes.

The amount of consuming the polarity control agent employed for the magnetic toner is determined by the factors such as the sort of the firmly-binding resin, existence/non-existence of the additives employed as occasion demands, and the method of manufacturing the toner including the scattering method. The amount of consuming the polarity control agent is not limited to the one value.

Preferably, the polarity control agent is employed in the range of 0.1 through 20 wt % for the firmly-binding agent 100 wt %. In case that the amount of the employed polarity control agent is smaller than 0.1 wt %, the charging amount of the toner becomes insufficient and that is not practical. On the contrary, in case that the amount of the employed polarity control agent exceeds 20 wt %, the charging amount of the toner becomes too much and thereby the electrostatic attraction force between the polarity control agent and the carrier increases. Consequently, the flowing property liquidity is deteriorated and the image density is lowered inevitably.

Regarding the magnetic substance material employed for the magnetic toner, there are listed up the materials of metal, alloy (compound metal), and mixture of the metal such as iron oxides of magnetite, hematite and ferrite, etc., metals such as iron, cobalt and nickel, and the metal alloy and metal mixture formed with the above-mentioned metals and the other metals such as aluminum, cobalt, copper, lead, magnesium, tin, zinc, antimony, beryllium, bismuth, cadmium, calcium, manganese, selenium, titanium, tungsten, and vanadium.

Regarding those ferromagnetic substances (bodies), the preferable average diameter is almost 0.1 through 2 μm. The amount of ferromagnetic substance to be contained in the toner is almost 20 through 300 wt % for the resin component 100 wt %. In particular, 30 through 200 wt % is preferable for the resin component 100 wt %.

It may be allowable to add colorants to the magnetic toner of the embodiment according to the present invention as occasion demands.

As to the colorants of Black, for instance, it is possible to use carbon black, Aniline Black, furnace black and lamp black. As to the colorants of Cyan, for instance, it is possible to use Phthalocyanine Blue, Methylene Blue, Victoria Blue, Methyl Violet, Aniline Blue, and ultramarine blue, etc. As to the colorants of Magenta, for instance, it is possible to use Rhodamine 6G Lake, dimethyl quinacridone, Watchung Red, Rose Bengale, Rhodamine B, and Alizarine Lake, etc. As to the colorants of Magenta, for instance, it is possible to use Chrome Yellow, Benzidine Yellow, Hansa Yellow, Naphthol Yellow, molybdenum orange, Quinoline Yellow, and Tartrazine, etc.

It may be allowable to mix the magnetic toner of the embodiment according to the present invention with additives as occasion demands. As to the additives, for instance, it is preferable to use Teflon (name of an article of commerce), lubricants such as zinc stearate, abrasives such as cerium oxides, zirconium oxides, silicon oxides, titanium oxides, aluminum oxides, and silicon carbide, fluidity applying agents such as colloidal silica, and aluminum oxides, anti-caking agent, electric conductivity applying agents such as carbon black and tin oxides, fixing assisting agents such as low molecular weight polyolefin.

Next, the example of manufacturing the developing solution employed in the embodiment of the present invention is described hereinafter. At first, the example of manufacturing the toner is shown below.

Styrene-acrylate resins (Himer 75; manufactured by Sanyo Chemical Industries, Ltd.) —100 wt % (% by weight)

carbon black (#44; manufactured by Mitsubishi Chemical Industries, Ltd.)—5 wt %

Nigrosine dyes (Nigrosine Base Ex; manufactured by Orient Chemical Industries, Ltd.)—2 wt % particulate magnetite (EPT-1000; manufactured by Toda Industries, Ltd.)—5 through 60 wt %

The mixture as shown above contains the magnetic substance with the containing rate of 5 through 35 wt %. The substance (mixture) is fused and mixingly kneaded with the thermal roller of 120° C. Thereafter, the magnetic substance is cooled and solidified and crushed (reduced to powder) with the jet mill and partially supplied.

In such manner, toner particle of the average diameter 8 μm could be obtained. The saturated magnetization of the toner mentioned heretofore was 21 A.m2/kg in the magnetic field of 8.0×104 A/m.

Next, the example of manufacturing the magnetic carrier is described hereinafter.

Magnetite is made by the wet method, and the magnetite 100 wt % thus made is put in a ball mill together with polyvinyl alcohol 2 wt % and water 60 wt %. All of the above materials are mixed in the ball mill for 12 hours, and the slurry of the magnetite is adjusted during that time. The slurry thereof is sprayed into particle by use of a spray dryer, and thereby spherical particles of average diameter 60 μm can be obtained. The particles thus obtained are sintered for 3 hours with the temperature of 1000° C. under the nitrogen atmosphere, and thereafter cooled. In such way, a core particle can be obtained.

The mixture of the following materials:

silicone resin solution (SR-2410; manufactured by Dow Corning-Toray Silicone Co., Ltd.)—100 wt % toluene—100 wt % methyltrimethoxysilane—6 wt % carbon black (#; manufactured by Mitsubishi Chemical Industries, Ltd.)—10 wt % is dispersed with a homo-mixer for 20 minutes, and cover layer forming liquid is adjusted.

The surface of the core particle of 1,000 wt % is coated with the adjusted cover layer forming liquid by use of a fluidized bed type coating apparatus. In such way, a silicone resin coating carrier can be obtained. The silicone resin coating carrier has an average particle diameter 63 μcm and a saturated magnetization 66 A.m2/kg.

Figure 7:
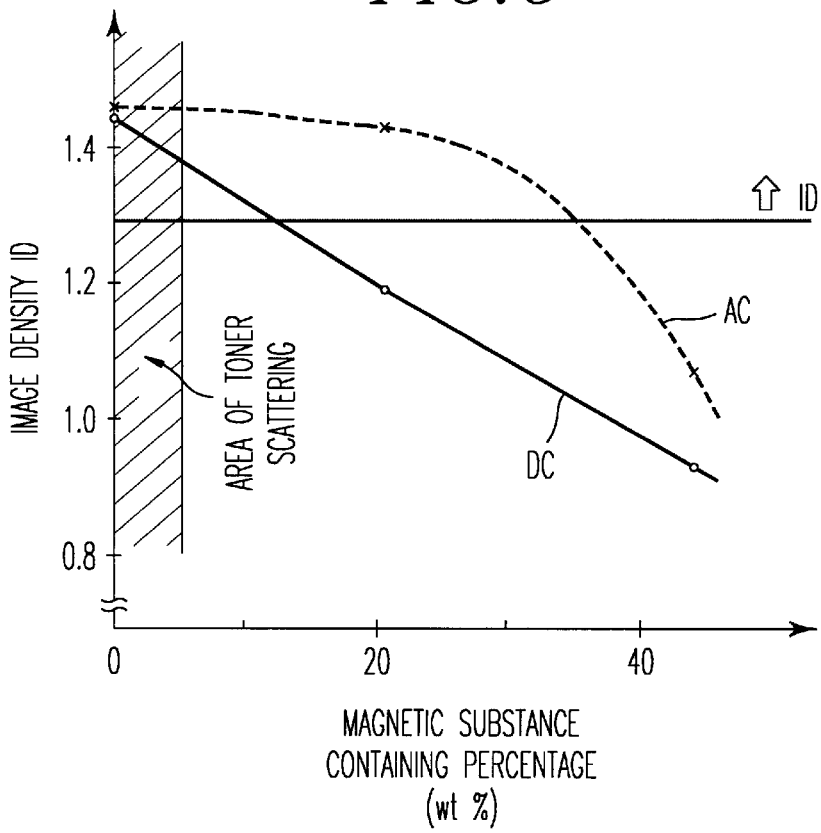
FIG. 7 is a property diagram showing the result of the experiment of the image forming device including the two-component magnetic brush type developing apparatus employing the developing solution composed of the magnetic toner end the magnetic carrier.

FIG. 7 is a property diagram showing the result of the experiment of the image forming device including the two-component magnetic brush type developing apparatus employing the developing solution composed of the magnetic toner and the magnetic carrier.

In FIG. 7, solid line represents the relationship between the magnetic substance containing amount (percentage) of the magnetic toner and the image density ID in the case of applying the developing bias composed of only the DC bias to the two-component magnetic brush type developing apparatus. On the other hand, dotted line represents the relationship therebetween in the case of applying the developing bias composed of the DC bias and the AC bias superposed thereon to the two-component magnetic brush type developing apparatus.

According to the result of the above experiment, in the image forming device including the two-component magnetic brush type developing apparatus employing the developing solution composed of the magnetic toner and the magnetic carrier in which the developing bias composed of the DC bias and the AC bias superposed thereon is applied to the two-component magnetic brush type developing apparatus, the phenomenon of toner scattering way occur if the magnetic substance containing amount (percentage) is set to less than 5%.

However, the toner scattering can be securely prevented with sufficient margin by setting the magnetic substance containing percentage of the toner to a value equal to or more than 5%. On the other hand, if the magnetic substance containing percentage of the toner is set to 35% or less, even though the ratio Vs/Vp is lowered, the development capacity can be secured, namely, the image density to be required can be secured. In addition, the problems of the two-component magnetic brush type developing apparatus that the line image becomes deteriorated and the troublesome matters such as halftone rear edge blanking occur can be solved. Consequently, the image of preferable line image and halftone, etc. can be obtained, and thereby the image of high quality can be obtained apparently.

Namely, according to the relationship between the magnetic substance including percentage (wt %) and the resistance value (Log Ω) of the developing solution, in case that the resistance value (Log Ω) of the developing solution in the state of putting that on the developing solution carrier is in the area (range) of 9.2 through 12.0, sufficient image density ID can be secured.

Consequently, in the image forming device provided with the two-component magnetic brush type developing apparatus for developing the latent image with the two-component developing solution including the magnetic toner in which the developing bias composed of the DC bias and the AC bias superposed thereon is applied to the developing solution carrier from the developing bias applying medium, since the magnetic substance containing percentage of the magnetic toner is set to 5 wt % through 35 wt %, even though the ratio Vs/Vt is lowered in the two-component magnetic brush type developing apparatus employing the two-component developing solution composed of the magnetic toner and the magnetic carrier and the developing bias composed of the DC bias and the AC bias superposed thereon is applied to the developing apparatus, the development capacity can be secured. In addition, no toner scattering occurs and thereby the image of preferable line image and halftone, etc. can be obtained. Consequently, the image of high quality can be obtained apparently.

Furthermore, according to the second status of the present invention, in the image forming device provided with the two-component magnetic brush type developing apparatus in which the developing bias composed of the DC bias and the AC bias superposed thereon is applied to the developing apparatus and the latent image is developed with the two-component developing solution including the magnetic toner and carrier, since the resistance value (Log Ω) of the two-component developing solution is set to 9.2 through 12, the image of sufficient density can be obtained.

Although the embodiment according to the present invention is described heretofore, the invention is not limited to the embodiment. Obviously, many other embodiments or the modifications of the present invention are possible in light of the above teachings. It is therefore to be understood that within the scope of the appended claims, the invention may be practiced otherwise than as specifically described herein.

Having now fully described the invention, it will be apparent to one of ordinary skill in the art that many changes and modifications can be made thereto without departing from the spirit and scope of the invention as set forth herein. This application is based on Japanese Patent Application No. 09-173740, filed on Jun. 30, 1997, and Japanese Patent Application No. JA AP10-16 9823 filed on Jun. 17, 1998; respectively the entire contents of which are herein incorporated by reference.

What is claimed as new and desired to be secured by Letters Patent of the United States is:

1. An image forming device, comprising:

a two-component magnetic brush type developing apparatus configured to develop a latent image; and a two-component developing agent including a magnetic carrier and a magnetic toner to which a development bias composed of a DC bias and an AC bias superposed on each other is applied, said two-component magnetic brush type developing apparatus configured to develop the latent image with the two-component developing agent, wherein a percentage value of magnetic material contained in said magnetic toner is set to an inclusive continuous range of 5 wt % to, and including, 35 wt %.

2. The image forming device of claim 1, wherein:

said two-component developing agent includes a developing solution.

3. An image forming device comprising:

a two-component magnetic brush type developing apparatus configured to develop a latent image;

a two-component developing agent including a magnetic toner and a carrier to which a development bias composed of DC bias and AC bias superposed on each other is applied, said two-component magnetic brush type developing apparatus configured to develop said latent image with the magnetic toner, wherein a resistance value of said two-component developing solution on a developing solution carrier is set in a continuous inclusive range of 9.2 to, and including, 12 Log Ω.

4. The image forming device of claim 3, wherein:

said two-component developing agent includes a developing solution.

5. An image forming device provided with a two-component developing apparatus comprising:

a latent image forming apparatus configured to form a latent image;

a latent image carrier configured to hold the latent image thereon, said latent image being formed by said latent image forming apparatus; and a two-component magnetic brush type developing apparatus, including a developing agent carrier configured to hold thereon a two-component developing agent, a container that holds the two-component developing agent composed of magnetic toner and magnetic carrier, a doctor blade configured to scape off a toner from said developing agent carrier; and a toner supplying member including a toner hopper, a toner supplying outlet, and a toner replenishing and agitating member wherein said two-component developing agent includes a developing solution, and a resistance value of said two-component developing solution on said developing solution carrier is set in a continuous, inclusive range of 9.2 to, and including, 12 Log Ω.

6. A method of forming an image with a two-component developing apparatus, comprising the steps of:

forming a latent image by a latent image forming apparatus on a latent image carrier;

holding the latent image formed by said latent image forming apparatus on said latent image carrier;

preparing a developing agent carrier for holding thereon developing agent;

preparing a container for containing two-component developing agent composed of a magnetic toner and a magnetic carrier;

preparing a toner supplying member including a toner hopper, a toner supplying outlet, and a toner replenishing and agitating member; and developing the latent image held on said latent image carrier with the magnetic toner of the two-component developing agent, wherein said two-component developing agent includes a developing solution, and the resistance value of said two-component developing solution on a developing solution carrier is set in an inclusive, continuous range of 9.2 to, and including, 12 Log Ω.

7. A method of forming an image with a two-component developing apparatus, comprising the steps of:

forming a latent image by a latent image forming apparatus on a latent image carrier;

holding the latent image formed by said latent image forming apparatus on said latent image carrier;

preparing a developing agent carrier for holding thereon developing agent;

preparing a container for containing two-component developing agent composed of a magnetic toner and a magnetic carrier;

preparing a toner supplying member including a toner hopper, a toner supplying outlet, and a toner replenishing and agitating member;

developing the latent image held on said latent image carrier with the magnetic toner of the two-component developing agent;

preparing a mixture of the magnetic toner, including, mixing styrene-acrylate resins, carbon black, Nigrosine dyes, and particulate magnetite;

fusing and mixingly kneading said mixture with a thermal roller;

cooling and solidifying said mixture after said fusing step; and crushing said mixture, after said cooling and solidifying step, into a powder so as to obtain toner particles with a predetermined diameter, wherein said two-component developing agent includes a developing solution.

8. A method of forming an image with a two-component developing apparatus, comprising the steps of:

forming a latent image by a latent image forming apparatus on a latent image carrier;

holding the latent image formed by said latent image forming apparatus on said latent image carrier;

preparing a developing agent carrier for holding thereon developing agent;

preparing a container for containing two-component developing agent composed of a magnetic toner and a magnetic carrier;

preparing a toner supplying member including a toner hopper, a toner supplying outlet, and a toner replenishing and agitating member;

developing the latent image held on said latent image carrier with the magnetic toner of the two-component developing agent;

manufacturing said magnetic carrier, including, making magnetite 100 wt % by a wet method, putting said magnetite 100 wt % thus made in a ball mill together with polyvinyl alcohol 2 wt % and water 60 wt %, mixing in the ball mill for 12 hours, and adjusting a slurry of the magnetite, spraying the slurry into particles by use of a spray dryer, and thereby making spherical particles of average diameter, sintering the spherical particles for between 2 through 4 hours at a temperature of 500 through 1500° C. under a nitrogen atmosphere, cooling the spherical particles after said sintering step in order to obtain a core particle, preparing a mixture of silicone resin solution, toluen, methyltrimethoxysilane, and carbon black, dispersing the mixture with a homo-mixer for 15 through 25 minutes; and adjusting a cover layer forming liquid, wherein a surface of the core particle of 500 through 1500 wt % is coated with the cover layer forming liquid, after being adjusted, by use of a fluidized bed type coating apparatus, and wherein a silicone resin coating carrier thus obtained has a predetermined average particle diameter size and a saturated magnetization, wherein said two-component developing agent includes a developing solution.

* * * * *

UNITED STATES PATENT AND TRADEMARK OFFICE

CERTIFICATE OF CORRECTION

PATENT NO. : 6,141,521
DATED : October 31, 2000
INVENTOR(S) : Kazuhiko Yuuki, et al.

It is certified that error appears in the above-identified patent and that said Letters Patent is hereby corrected as shown below:

Title page,
Item [75] the Fourth Inventor's name is spelled incorrectly, item [75] should read as follows:
--[75] Inventors: Kazuhiko Yuuki, Kawasaki; Shinji Tamaki, Tokyo; Manabu Mochizuki, Yokohama; Takeshi Saito, Tokyo, all of Japan--

Title page,
Item [30] the Foreign Application Priority Data is incorrect, item [30] should read as follows:
--[30] Foreign Application Priority Data

| | | | |
|---|---|---|---|
| Jun. 30, 1997 | [JP] | Japan | 9-173740 |
| Jun. 17, 1998 | [JP] | Japan | 10-169823-- |

Signed and Sealed this

Third Day of July, 2001

Nicholas P. Godici

*Attest:*

*Attesting Officer*

NICHOLAS P. GODICI
*Acting Director of the United States Patent and Trademark Office*